US006619708B1

(12) United States Patent
Naylor

(10) Patent No.: US 6,619,708 B1
(45) Date of Patent: Sep. 16, 2003

(54) LOCKDOWN SECURITY DEVICE

(76) Inventor: Wayne Naylor, P.O. Box 641, Bellview, FL (US) 34421

( * ) Notice: Subject to any disclaimer, the term of this patent is extended or adjusted under 35 U.S.C. 154(b) by 0 days.

(21) Appl. No.: 10/041,462

(22) Filed: Jan. 10, 2002

(51) Int. Cl.[7] ..... E05C 19/18
(52) U.S. Cl. ..... 292/259 R; 70/14; 292/339
(58) Field of Search ..... 292/259 R, 339; 70/14, 93

(56) References Cited

U.S. PATENT DOCUMENTS

| | | | | | |
|---|---|---|---|---|---|
| 584,017 | A | * | 6/1897 | Sewell | |
| 2,479,096 | A | | 8/1949 | Bratz | |
| 3,643,478 | A | * | 2/1972 | McPeake | 70/212 |
| 3,806,265 | A | * | 4/1974 | Hattan | 29/175 R |
| 4,187,702 | A | * | 2/1980 | Benton | 70/57 |
| 4,340,196 | A | * | 7/1982 | Eldred | 244/1 R |
| 4,560,192 | A | * | 12/1985 | Wilson | 292/339 |
| 4,666,106 | A | * | 5/1987 | Kohout | 244/129.3 |
| D291,963 | S | * | 9/1987 | Farmer | D8/394 |
| 5,018,690 | A | * | 5/1991 | Widmer | 246/428 |
| 5,144,724 | A | * | 9/1992 | Chuan | 24/68 CD |
| D346,106 | S | | 4/1994 | Walls | |
| 5,431,461 | A | * | 7/1995 | Andersen | 292/259 |
| 5,447,346 | A | * | 9/1995 | Virzi | 292/289 |
| 5,724,839 | A | * | 3/1998 | Thering | 70/18 |
| 5,865,485 | A | | 2/1999 | Lawhorne, Jr. | |
| 5,927,107 | A | | 7/1999 | Mitchel | |
| 6,058,749 | A | * | 5/2000 | Rekemeyer | 70/226 |

* cited by examiner

*Primary Examiner*—G. Estremsky
(74) *Attorney, Agent, or Firm*—Patent Trademark Services; Joseph H. McGlynn

(57) ABSTRACT

A door locking system for a tractor trailer cab for locking a pair of opposed doors from the inside in order to prevent them from being opened while the driver sleeps. The locking system includes a pair of links and shoe elements adapted to engage various parts of the door in a way that makes them non-removable when the links are tensioned, even when the windows are rolled partially down for ventilation. A toggle bolt assembly is provided between adjacent links to shorten the assembled links in order to pull the doors together and prevent their opening or to lengthen the assembly to release the doors. One or both of the shoes may be removable and replaceable with attachment shoes having a different shape in order to adapt the device for different door configurations.

11 Claims, 1 Drawing Sheet

LOCKDOWN SECURITY DEVICE

BACKGROUND OF THE INVENTION

Tractor trailers often carry cargos worth tens or even hundreds of thousands of dollars. Additionally the truck driver may be carrying a certain amount of cash for operating expenses and emergency services. This makes him or her an attractive target for robbery which may result in injury or personal loss.

An additional problem is that drivers are required by federal law to take a mandatory rest break after a certain number of hours on the road. This often means that drivers must stop at lonely and secluded spots along the highway, ideal locations for a robbery. In addition to this, vehicle door locks are notoriously insecure in that they can be easily broken, jimmied or picked, leaving the driver exposed to theft, kidnapping and injury.

This invention relates, in general, to a lockdown security device for a tractor tailor, and, in particular, to a device for protecting the driver of a tractor trailer when he or she is taking a rest period by locking the cab of a tractor trailer from the inside so that the doors cannot be opened by people outside the cab.

DESCRIPTION OF THE PRIOR ART

In the prior art various types of security locking devices have been proposed. For example, U.S. Pat. No. 5,927,107 to Mitchell discloses an extensible rod which can be locked at a particular length in order to prevent unauthorized persons from opening a trunk packed into the hold of a ship or other small room or compartment.

U.S. Pat. No. 5,865,485 to Lawhorne discloses a vehicle door locking system that hooks into the window pockets of a truck door.

U.S. Pat. No. 2,479,096 to Bratz discloses a turnbuckle having a locking device.

Design Patent 346,106 to Walls appears to show a locking device for swinging doors that prevents the doors from swinging inward by clamping onto the door frames and adjusting inward by means of a turnbuckle.

SUMMARY OF THE INVENTION

The present invention is directed to an improved locking device for tractor trailers adapted to be hooked over the door handle, pull strap, storage pocket or other part of the door mechanisms on opposite sides of the truck, and tensioned by a shortening mechanism in order to pull the doors towards each other to prevent opening from the outside.

It is an object of the present invention to provide a new and improved door locking mechanism which can be attached to many different door configurations.

It is also an object of the present invention to provide a new and improved door locking mechanism which is quickly disassembled for storage.

It is further an object of the present invention to provide a new and improved door locking mechanism which permits the driver to leave one or both windows of the cab at least partly open without fear that someone could reach in and release the door locking mechanism while the driver sleeps.

These and other objects and advantages of the present invention will be fully apparent from the following description, when taken in connection with the annexed drawings.

DESCRIPTION OF THE PREFERRED EMBODIMENT

Figure 1:
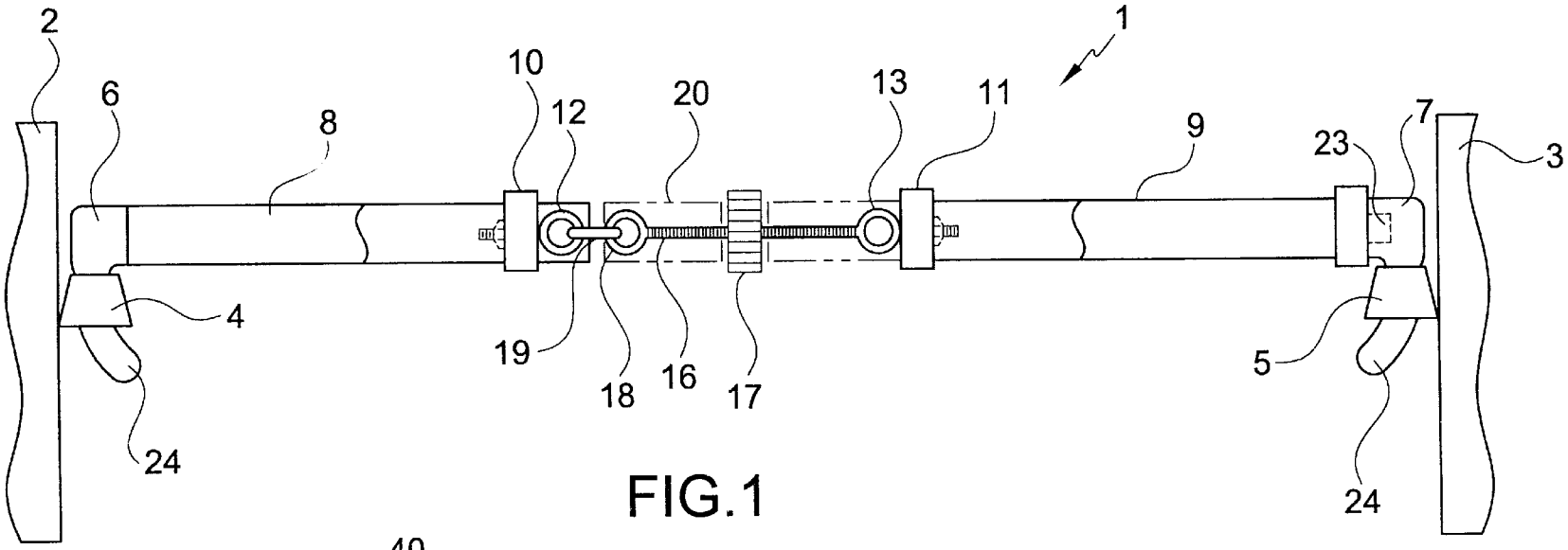
FIG. 1 is a section view of the present invention with cover sleeves and tube parts cut away to show the operation of the tensioning rod and eye bolt assembly.

Referring now to the drawings in greater detail, FIG. 1 shows a cut away portion of opposite doors of a tractor tailor cab having interior door panels 2 and 3 and attached pull straps 4 and 5. A door locking device 1, in accordance with the instant invention is shown hooked into the pull straps 4 and 5 and pulling the straps together in such a way that the doors cannot be opened outward.

The door locking assembly 1 includes a first shoe 6 fixedly attached to a hardened steel rod 8 and a second shoe 7 removably attached to a hardened steel rod 9. A similar hooking device is shown in U.S. Pat. No. 5,865,485 adapted to hook into the window pockets. The prior art device, however, practically requires that the driver roll the windows up, which often means that he must leave his engine running and the air conditioning on, because lowering the window even a little means that a potential hijacker can reach in through the partly open window with his hand or some other device and pull the hooking device out of the window pocket and open the door.

Not only does the inwardly curved toe 24 on the shoes 6, 7 positively prevent the shoes from being ripped out, but also, one or both of the shoes may be made removable and replaceable with shoes of a different shape to adapt the device for different door configurations. In FIG. 1, for example, the shoe 7 is threaded on to hardened link 9 at 23. For certain situations the shoe may be unscrewed from the link and replaced with a plate.

A pair of nuts 10 and 11 are welded, or otherwise permanently attached, to each of the hardened steel rods 8, 9 and positioned towards the center of the truck cab so that the mechanism connecting them is not conveniently reachable from the windows, even when the windows are slightly cracked for ventilation. Nut 10 will have a left-handed thread while nut 11 will have a right-handed thread.

An eye bolt 12 with a left-hand thread is threaded into nut 10 on one side of the locking assembly, while on the other side a right-hand eye bolt 13 is fixedly secured to a tensioning rod 16 which is fixedly secured to tensioning sleeve 17 and ring 18. A removable C-shaped link 19 is hooked over ring 18 and the eye of eye blot 12 so that turning the tensioning sleeve 17 will shorten or lengthen the locking assembly causing shoes 6 and 7 to grip or release door pulls 4 and 5.

A pair of tubular shells 20 and 21 cover and conceal the operating mechanism from view.

Figure 2:
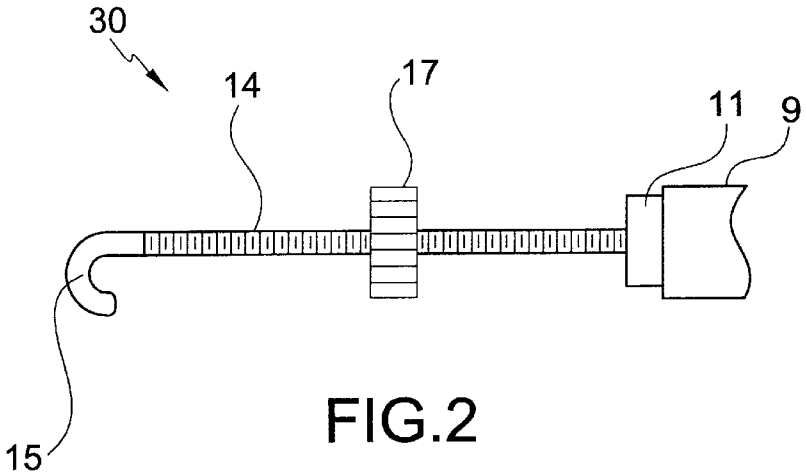
FIG. 2 is a modified and simplified version of the tensioning rod and eye bolt assembly.

FIG. 2 shows an alternative embodiment in which the right-hand thread eye bolt 13, the tensioning rod 16, the ring 18 and the C-shaped link 19 are all replaced by a J-bolt assembly 30 having a J-bolt 14 with a hooked end 15. According to this embodiment the threaded end of the J-bolt is threaded into nut 11 in the usual way and the hooked end 15 is hooked into eye 12 as shown in FIG. 1. Turning the tensioning sleeve 17 will cause both the eye bolt 12 and the J-bolt 14 to rotate in the same direction and shorten or lengthen in order to tension or release the locking device.

In both embodiments the tensioning sleeve 17 may be made of hard plastic material which can be fiber reinforced and molded about the tensioning rod 16 or J-bolt 14.

Figure 3:
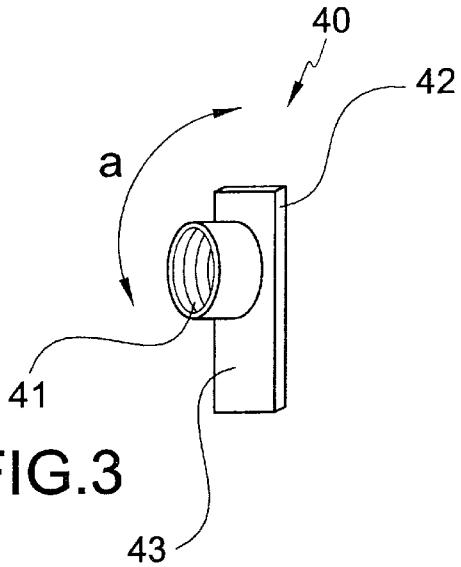
FIG. 3 shows an alternative shoe adapted for use on a window pocket.

In an alternative embodiment shown in FIG. 3 the removable shoe 7 could be replaced by window pocket shoe 40 having an angularly-disposed window pocket plate 42 and having a threaded cup 41 and an inward directed toe 43. This embodiment is similar to that of the Lawhorne patent 5,865,485, but this configuration would allow the end 42 to be inserted into a window pocket while the other end 43 is hooked into a door handle, pull strap 5 or door pocket. In so doing the locking device will extend downward at a slight angle a so that the plate end will be pulled downward and inward towards the handle, pull strap or door pocket and the downward angle will ensure that the window pocket end will be positively locked into the window pocket and not be removable therefrom with out releasing the tensioning mechanism. Also, the hardened steel of the links 8, 9 will prevent someone from reaching in through a partially opened window with snips to cut the links 8 or 9.

Although the Lockdown Security Device and the method of using the same according to the present invention has been described in the foregoing specification with considerable details, it is to be understood that modifications may be made to the invention which do not exceed the scope of the appended claims, and modified forms of the present invention done by others skilled in the art to which the invention pertains will be considered infringements of this invention when those modified forms fall within the claimed scope of this invention.

What I claim as my invention is:

1. A door locking device for locking the doors in a cab of a vehicle having a pair of doors with openable windows, said doors being locked by said device from the inside in order to protect the driver while he or she sleeps, said device comprising:

a pair of links having adjacent ends and distal ends, a connecting means for joining adjacent ends of said pair of links, said connecting means being extensible and retractable from the center of the cab when the links are connected for applying substantial tensile force on said pair of links, and means for engaging each of said doors, each means for engaging each of said doors having means for preventing each means for engaging each of said doors from being ripped out of engagement with said doors by persons reaching in through a partially opened window of said cab, and wherein the connecting means for joining adjacent ends of said links comprises threaded nuts attached to adjacent ends of said links, one of said nuts having right-hand threads and the other nut having left-hand threads, and said connecting means comprises a bolt assembly threaded through said nuts, whereby turning said bolt assembly in one direction will draw said links together to apply substantial locking tension on said links, and turning said assembly in another direction will release tension on said links to make said links removable from their connecting points, and wherein the bolt assembly includes a J-bolt threaded onto one of said nuts, and an eye bolt threaded into another of said nuts, whereby the J-bolt can be hooked into the eye and both rotated together to shorten or lengthen the door locking device.

2. A door locking device as claimed in claim 1, wherein means for preventing each means for engaging each of said doors from being ripped out of engagement with said doors is an inwardly curved end, whereby when the means for engaging each of said doors are linked onto said doors and are adjusted inwardly, the tensile force will prevent said means for engaging each of said doors from being ripped from their points of connection by persons reaching in through the window.

3. A door locking device as claimed in claim 1, wherein one of the means for engaging each of said doors is removable and replaceable with another means having a different configuration from the means for engaging each of said doors.

4. A door locking device as claimed in claim 3, wherein one of the means for engaging each of said doors has a curved shape for hooking into a pull strap, and the other means is a plate adapted for insertion into a window pocket, the plate being disposed at a slight angle to an adjacent link, whereby when the links are tensioned the plate will be pulled down and into the window pocket in such a way that it cannot be removed until the tension on the link is released.

5. A door locking device as claimed in claim 1, wherein the bolt assembly includes a tensioning sleeve adapted to assist in turning said bolt assembly.

6. A door locking device for locking the doors in a cab of a vehicle having a pair of doors with openable windows, said doors being locked by said device from the inside in order to protect the driver while he or she sleeps, said device comprising:

a pair of links having adjacent ends and distal ends, each of said pair of links having a length adapted to extend approximately half way across said cab, a connecting means for joining adjacent ends of said pair of links, said connecting means being extensible and retractable from the center of the cab when the links are connected for applying substantial tensile force on said pair of links, and means for engaging each of said doors, each means for engaging each of said doors having means for preventing each means for engaging each of said doors from being ripped out of engagement with said doors by persons reaching in through a partially opened window of said cab, and wherein one of the means for engaging each of said doors is removable and replaceable with another means having a different configuration from the means for engaging each of said doors.

7. A door locking device as claimed in claim 6, wherein means for preventing each means for engaging each of said doors from being ripped out of engagement with said doors is an inwardly curved end, whereby when the means for engaging each of said doors are linked onto said doors and are adjusted inwardly, the tensile force will prevent said means for engaging each of said doors from being ripped from their points of connection by persons reaching in through the window.

8. A door locking device as claimed in claim 6, wherein one of the means for engaging each of said doors has a curved shape for hooking into a pull strap, and the other means is a plate adapted for insertion into a window pocket, the plate being disposed at a slight angle to an adjacent link, whereby when the links are tensioned the plate will be pulled down and into the window pocket in such a way that It cannot be removed until the tension on the link is released.

9. A door locking device as claimed in claim 6, wherein the connecting means for joining adjacent ends of said links comprises threaded nuts attached to adjacent ends of said links, one of said nuts having right-hand threads and the other nut having left-hand threads, and said connecting means comprises a bolt assembly threaded through said nuts, whereby turning said bolt assembly in one direction will draw said links together to apply substantial locking tension on said links, and turning said assembly in another direction will release tension on said links to make said links removable from their connecting points.

10. A door locking device as claimed in claim 6, wherein the bolt assembly includes a tensioning sleeve adapted to assist in turning said bolt assembly.

11. A door locking device as claimed in claim 6, wherein the bolt assembly includes a J-bolt threaded onto one of said nuts, and an eye bolt threaded into another of said nuts, whereby the J-bolt can be hooked into the eye and both rotated together to shorten or lengthen the door locking device.

* * * * *